United States Patent [19]

Moertel

[11] 4,419,793

[45] Dec. 13, 1983

[54] CONTINUOUS FILAMENT SLIDE FASTENER WITH CUTAWAY HEELS

[75] Inventor: George B. Moertel, Conneautville, Pa.

[73] Assignee: Talon, Inc., Meadville, Pa.

[21] Appl. No.: 311,818

[22] Filed: Oct. 16, 1981

[51] Int. Cl.[3] ..... A44B 19/12

[52] U.S. Cl. ..... 24/413; 29/410

[58] Field of Search ..... 24/205 R, 205.16 R, 24/205.16 C, 205.13 C

[56] References Cited

U.S. PATENT DOCUMENTS

| | | | |
|---|---|---|---|
| 3,255,504 | 6/1966 | Porepp | 24/205.16 C X |
| 3,605,206 | 9/1971 | Fröhlich | 24/205.16 C X |
| 4,045,846 | 9/1977 | Moertel | 24/205.16 C |

*Primary Examiner*—Robert P. Swiatek

*Attorney, Agent, or Firm*—Anthony A. O'Brien

[57] ABSTRACT

Heel portions of filamentary coupling members have cross-sectional areas that are reduced relative to the cross-sectional areas of the adjoining leg portions by means of the removal of portions of the heels. The reduced cross-sectional areas in the heels of the filamentary members result in easier slider operation and/or greater crosswise slide fastener strength.

34 Claims, 30 Drawing Figures

CONTINUOUS FILAMENT SLIDE FASTENER WITH CUTAWAY HEELS

TECHNICAL FIELD

The present invention relates to slide fasteners employing continuous filament locking elements which have been configured into coils or meander patterns and attached or mounted on the edges of carrier tapes.

BACKGROUND ART

The prior art, as exemplified in U.S. Pat. Nos. 2,919,482, 3,015,868, 3,197,537, 3,199,162, and 3,908,242, contains a number of slide fasteners having continuous filaments formed into coils or meander patterns to form interlocking coupling elements wherein heel portions of the filament convolutions contain notches or flattened segments. These notches or flattened portions are formed by crimping rollers deforming the filament cross section during the formation of the filament into the desired coil or meander configuration. These notches or flattened heels are utilized to retain attaching threads or to form slider flange engaging surfaces.

SUMMARY OF THE INVENTION

The invention is summarized in a stringer for a slide fastener including a support tape; a filamentary member mounted on the support tape and including a continuous filament formed into successive convolutions defining coupling elements wherein each coupling element has a head portion, a pair of leg portions extending from opposite sides of the head portion, and a heel portion connecting one of the leg portions to a corresponding leg portion of an adjacent coupling element; the filament in the leg portions having a substantially uniform cross-sectional area; and the filament in the heel portions having cross-sectional areas which are substantially reduced in size relative to the cross-sectional area of the leg portions by having portions of the filament removed therefrom.

An object of the invention is to produce a stringer for a slide fastener employing a filamentary configured coupling member which has greater flexibility and/or greater interlocking strength with an opposing filamentary member.

One feature of the invention is that the removal or cutting away of portions of the heels or interconnecting segments of convolutions of a filamentary coupling member increases the flexibility, or reduces the resistance, of adjacent coupling elements to pivotal movement about the heels relative to each other in the plane of the supporting tapes.

One advantage of the invention is that the increase in flexibility of the filamentary coupling members in a slide fastener results in easier operation of the slider in opening and closing of the slide fastener without any decrease in the interlocking strength of the slide fastener.

Another advantage of the invention is that head-to-head spacing of configured coupling elements in filamentary members of a slide fastener can be decreased to increase the interlocking strength of the slide fastener without decreasing the ease of operation of the slide fastener.

Still another advantage of the invention is that removal of portions of the heels of filamentary coupling members does not distort the configured spacing or positioning of the coupling elements.

Other objects, advantages and features of the invention will be apparent from the following description of the preferred embodiment taken in conjunction with the accompanying drawings.

DESCRIPTION OF THE PREFERRED EMBODIMENT

Figure 1:
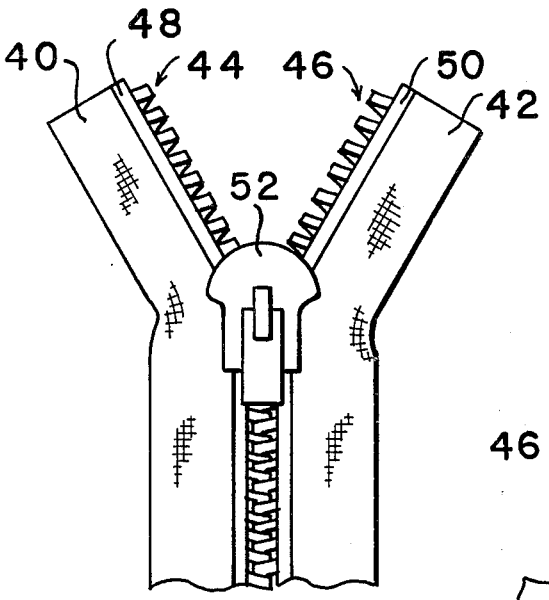
FIG. 1 is a plan view of a slide fastener in accordance with the invention.

As shown in FIGS. 1, 2, 3 and 4, one embodiment of a slide fastener manufactured in accordance with the invention includes a pair of support tapes 40 and 42 having filamentary coil coupling members indicated generally at 44 and 46 and mounted on inner beaded edges 48 and 50 of the tapes 40 and 42. A slider 52 is mounted for sliding movement along the beaded edges 48 and 50 for opening and closing the slide fastener. The tape 40 and coupling member 44 form a left stringer for the slide fastener while the tape 42 and coupling member 46 form a right stringer for the slide fastener; the right stringer is a mirror image of the left stringer.

Figure 2:
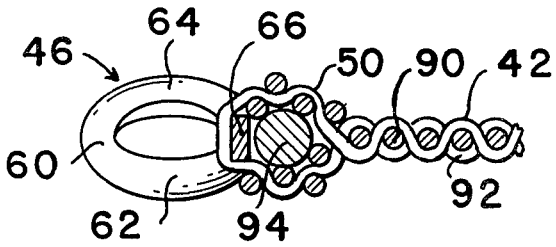
FIG. 2 is a cross-sectional view of a portion of one stringer of the slide fastener of FIG. 1.
Figure 3:
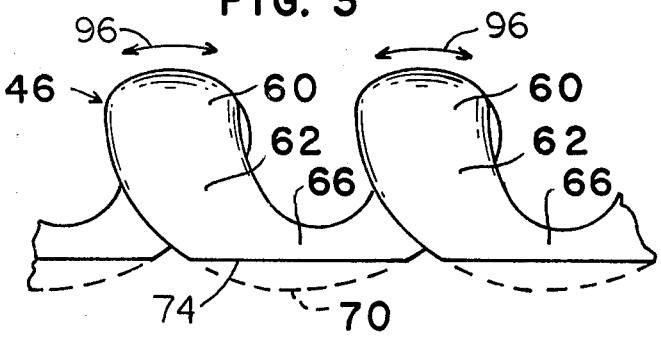
FIG. 3 is a plan view of a filamentary coil coupling member removed from the stringer of FIG. 2.
Figure 4:
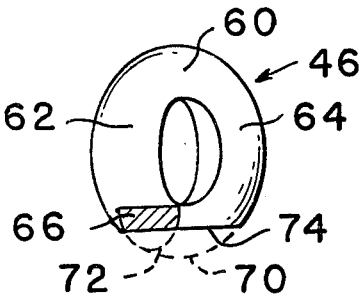
FIG. 4 is a cross-sectional view of the filamentary member of FIG. 3.

As shown in FIGS. 2, 3 and 4, the coupling member 46 is formed from a continuous filament of suitable material, such as a filament of thermoplastic having a D-shaped cross section, and is coiled in a conventional manner to form successive convolutions with each convolution forming a coupling element for interengaging with coupling elements of the opposing coil 44. Each convolution or coupling element includes a head portion 60, a pair of leg portions 62 and 64 extending from opposite sides of the head portion 60, and a heel or interconnecting portion 66 which joins with a corresponding leg portion of an adjoining convolution. The rounded surface of the D-shaped cross section is on the outside of the coil while the flat surface of the D-shaped cross section faces the interior of the coil.

The filamentary member 46 differs from prior art coil coupling members by having bottom surfaces 74, as viewed in FIGS. 3 and 4, which are flat due to the removal or cutting away of outer rounded portions indicated by the dashed line 70 of the heels 66. The D-shaped cross section of the filament is substantially uniform in cross-sectional area throughout the leg portions 62 and 64 and the head portions 60, but in the heel portions 66 the removal of the portions 70 of the mass of the coiled filament results in a cross section (see 66 in FIG. 4) having less cross-sectional area than the cross-sectional area of the filament in the leg portions 62 and 64. A cutaway or reduction in cross-sectional area at one point in the heel 66 is indicated by the dashed line 72 in FIG. 4.

Figure 5:
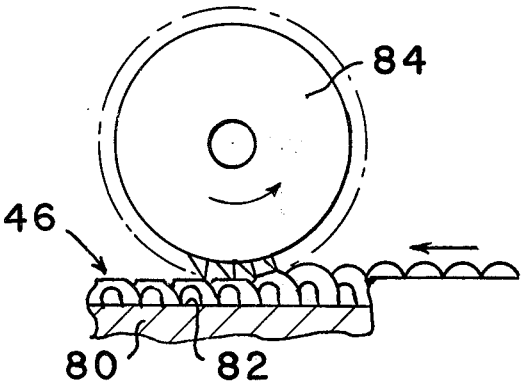
FIG. 5 is an elevational view of a heel portion removal mechanism used in one step of the manufacture of the filamentary member of FIGS. 3 and 4.
Figure 6:
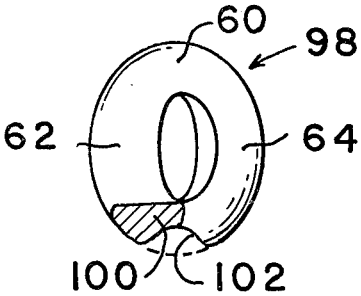
FIG. 6 is a cross-sectional view of a filamentary coil member with a second variation of the longitudinal cutaway suitable for use in stringers of a slide fastener in accordance with the invention.
Figure 7:
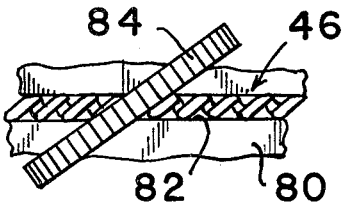
FIG. 7 is a plan view of another variation of the manufacturing mechanism of FIG. 5.
Figure 8:
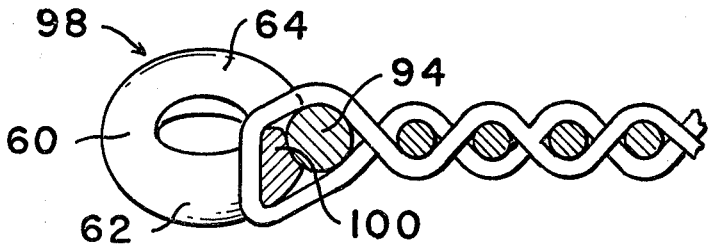
FIG. 8 is a cross-sectional view of a modified slide fastener stringer employing the coil coupling member of FIG. 6.
Figure 9:
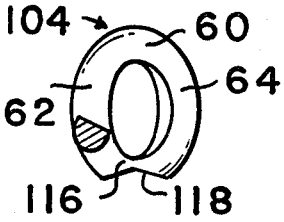
FIG. 9 is a cross-sectional view of a filamentary coil coupling member with a third variation of the longitudinal cutaway.

One apparatus and technique for removing the portions 70 from the heels 66 of the coupling members 44 and 46 is shown in FIG. 5. The coupling member 46 is formed in a conventional manner into a coupling coil. Then the coil 46 is fed through a groove 82 in a guide member 80 with the head portions guided against the bottom of the groove 82 so that the heels project out of the slot 82 above the guide 80. The coupling member 46 is passed beneath a high speed rotating milling cutter 84 with teeth of carbide or other suitable material which removes the portions 70 from the coils 46. Alternatively, as shown in FIG. 7, the cutter 84 may be mounted at an angle relative to the guide passageway 82. Also, other procedures such as laser or abrasive machining, melt removal, etc., may be used to remove the portions 70 from the coils 44 and 46.

The coils 44 and 46, with the bottom portions 70 of the heels cutaway, are mounted in the edges of the tapes 40 and 42 in a conventional manner by weaving the coils in the edges of the tapes during the weaving of the tapes 40 and 42. In this preferred embodiment, the weft thread 92 is interwoven with the warp threads 90 and passes around the heel or interconnecting portions 66 and a bead cord 94 to secure the coil 46 in the inner edge of the tape 42.

In operation of the slide fastener, the protruding coupling elements formed by the convolutions of the coils 44 and 46 are engaged and disengaged within the slider 52 by respective upward and downward movement of the slider 52. The protruding coupling elements formed by the legs 62 and 64 and heads 60 are flexed or pivoted relative to their adjoining coupling elements in the direction as shown by the arrows 96 in the plane of the tapes 40 and 42 about the heels 66 as the coupling elements pass through the slider 52. With the cross-sectional area of the heels 66 reduced, this flexing motion 96 is easier compared to flexing motion of coils not having the reduced cross section in the heels thereof. This results in easier operation of the slider 52 in that less force is required to open and close the slide fastener. The coupling elements or heads 60 may be spaced closer together on the edges of the tapes 40 and 42; closer spacing results in greater interlocking of the head portions 60 with the opposing coil to produce greater crosswise strength, i.e. strength or resistance to pulling forces on the tapes 40 and 42 tending to pull the tapes 40 and 42 apart in the planes of the tapes. Closer spacing of the heads 60 increases the force required to open and close the slide fastener; however, by proper selection of head-to-head spacing, an increase in crosswise strength and a reduction in slider resistance are both possible. The head-to-head spacing may be selected to maintain the same operating resistance but producing greater crosswise strength compared to coil elements not having heels with reduced cross sections. Further, the present invention results in an improved cost/performance ratio; slide fasteners with less costly, smaller coils replace slide fasteners with more expensive, larger coils, the fasteners with smaller coils having the same strength as the fasteners with larger coils.

In samples of the invention, portions of heels of conventional filamentary coupling coils were ground off. Prior to grinding, the coils had an outside diameter, measured from heel to head, of 1.83 millimeters (0.072 inches). The diameter was reduced to 1.65 millimeters (0.065 inches) in one sample and was reduced to 1.52 millimeters (0.060 inches) in another sample; 0.18 millimeters (0.007 inches) being ground off in the first sample and 0.31 millimeters (0.012 inches) being ground off in the second sample. The coils of the first sample were woven in tapes with a pitch of 32.5 convolutions per 5.08 centimeter (2 inch) segment of the coils of the second sample were woven in tapes with a pitch of 33 convolutions per 5.08 centimeter segment. These samples were then compared with a conventional coil slide fastener having a pitch of 32 convolutions per 5.08 centimeter segment. The forces required to move the sliders in both samples were substantially less than the force required to move the slider in the conventional fastener; the second sample with the 0.31 millimeter portion cutaway being the easiest to operate. Crosswise strength of the conventional slide fastener was measured at readings of 24 kilograms (52 lbs.) and 27 kilograms (60 lbs.) while crosswise strength of the first sample measured 45 kilograms (100 lbs.) in two readings and crosswise strength of the second sample measured 34 kilograms (75 lbs.) and 36 kilograms (80 lbs.).

Prior art flattening by mechanical deformation of the heels does not change the total mass present and may result in distortion of the coil. Such distortion may not be adequately controlled and may result in non-uniformity in head-to-head spacing as well as other parameters of the coil. Further, flattened heels do not produce greatly reduced cross-sectional areas since the flattening results mainly in changing the profile of the cross section; reduction in cross-sectional area by deformation is brought about only by lengthening of the heel portions producing the undesired distortion. The present reduction in cross-sectional sectional area of the heels 66 by removal of the portions 70 does not distort the coil pitch and shape of the coils and results in greater decrease in operating force and/or increase in crosswise strength compared to flattened heel portions.

Many different configurations of cutaways can be formed in the heels of the convolutions of the filamentary members to produce improved ease of operation and increased crosswise strength. The cutaways or flat surfaces 74 of the embodiment shown in FIGS. 1–4 can be formed longitudinally along the coils, or transversely relative to the coils. Examples of some of the other possible cutaway configurations that can be formed longitudinally along the coils are illustrated in FIGS. 6 and 8–14. Examples of some of the possible cutaway configurations that can be formed transversely in the bottoms, or outside surfaces, of the heels of the coils are illustrated in FIGS. 15–20. Examples of some of the possible configurations of cutaways that can be formed in the inner surfaces or portions of the heels of the coils are illustrated in FIGS. 21–27. Many other possible types of cutaway configurations are possible. The cutaway configuration can be selected in accordance with the desired properties of the filamentary member and the ease of manufacturing the configuration.

Figure 10:
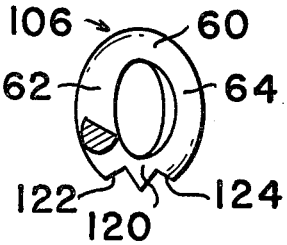
FIG. 10 is a cross-sectional view of a filamentary coil coupling member with a fourth variation of the longitudinal cutaway.
Figure 11:
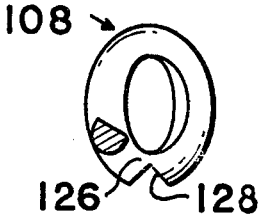
FIG. 11 is a cross-sectional view of a filamentary coil coupling member with a fifth variation of the longitudinal cutaway.
Figure 12:
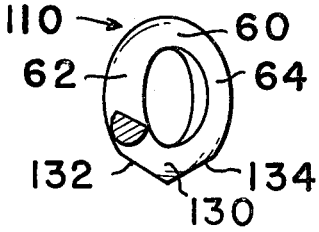
FIG. 12 is a cross-sectional view of a filamentary coil coupling member with a sixth variation of the longitudinal cutaway.
Figure 13:
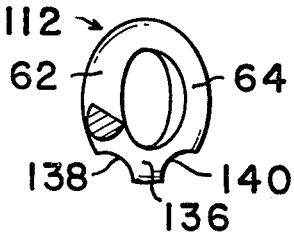
FIG. 13 is a cross-sectional view of a filamentary coil coupling member with a seventh variation of the longitudinal cutaway.
Figure 14:
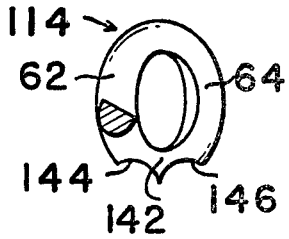
FIG. 14 is a cross-sectional view of a filamentary coil coupling member with an eighth variation of the longitudinal cutaway.
Figure 15:
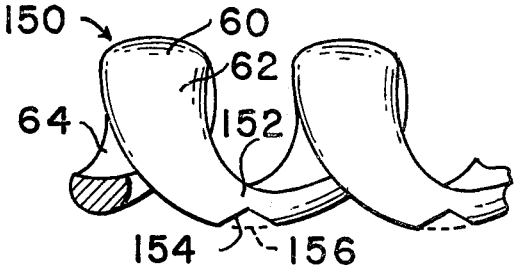
FIG. 15 is a side view of a modified filamentary coil coupling member having bottom transverse cutaways.

In the filamentary coil members 98, 104, 106, 108, 110, 112 and 114 of FIGS. 6 and 8–14, respectively, various longitudinally extending grooves or flat surfaces are formed along the heels. In the coil 98 of FIGS. 6 and 8, the heels 100 have cutaways or grooves 102 which extend longitudinally along the coil and which have a rounded cross section. Conveniently the cutaway 102 is designed to form a seat for retaining the bead cord 94 of the tape. In heels 116 of the coil 104 of FIG. 9, the longitudinally extending cutaway has a relatively broad V-shaped cross-sectional configuration. In FIG. 10, a pair of longitudinally extending V-shaped grooves 122 and 124 are formed in heels 120 of the coil 106. Heels 126 of the coil 108 of FIG. 11 have V-shaped notches 128 with substantially steeper sidewalls than that of FIG. 9. In FIG. 12, the heels 130 of the coil 110 have a pair of longitudinally extending flat surfaces 132 and 134 formed on the outer bottom corners of the coil 110 to extend longitudinally along the coil. Heels 136 and 142 of the coils 112 and 114 in FIGS. 13 and 14 have respective pairs of rounded grooves 138, 140, 144 and 146 which, in FIG. 13, are spaced substantially apart, and in FIG. 14, are closely positioned together.

Figure 16:
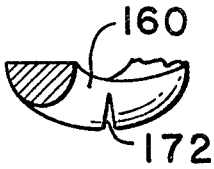
FIG. 16 is a side view of a broken-away heel portion of a filamentary coil coupling member with a second variation of the bottom transverse cutaways.
Figure 17:
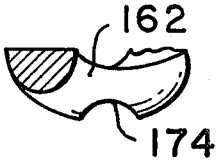
FIG. 17 is a side view of a broken-away heel portion of a filamentary coil coupling member with a third variation of the bottom transverse cutaways.
Figure 18:
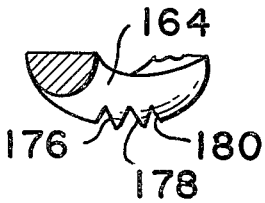
FIG. 18 is a side view of a broken-away heel portion of a filamentary coil coupling member with a fourth variation of the bottom transverse cutaways.
Figure 19:
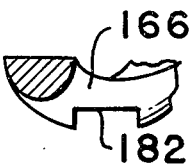
FIG. 19 is a side view of a broken-away heel portion of a filamentary coil coupling member with a fifth variation of the bottom transverse cutaways.
Figure 20:
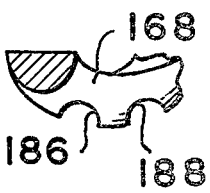
FIG. 20 is a side view of a broken-away heel portion of a filamentary coil coupling member with a sixth variation of the bottom transverse cutaways.
Figure 21:
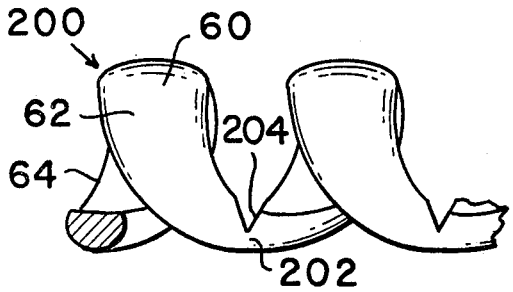
FIG. 21 is a side view of a third modification of the filamentary coil coupling member having transverse inside cutaways.

In the heels 152, 160, 162, 164, 166 and 168 of FIGS. 15–20, various shapes of cutaways or notches are formed transversely relative to the longitudinal dimension of the coils. In the heel 152 of FIG. 15, a V-shaped notch 154 is formed, the cutaway portion 156 indicated by the dashed line. In FIG. 16, a narrow notch or slit 172 is formed in the heel 160. A rounded cutaway or notch 174 is formed in the heel 162 of FIG. 17. The heel 164 of FIG. 18 has a plurality of V-shaped notches 176, 178 and 180 formed transversely to the longitudinal dimension of the coil. In FIG. 19, a notch 182 with square corners and a flat inside surface is formed in the heels 166. A pair of rounded notches 186 and 188 are formed in the heel 168 of FIG. 20.

Figure 22:
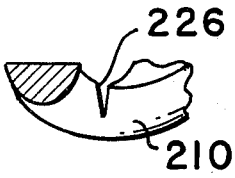
FIG. 22 is a side view of a broken-away heel portion of a filamentary coil coupling member with a second variation of the inside transverse cutaways.
Figure 23:
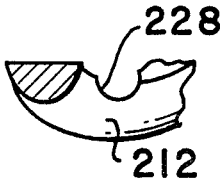
FIG. 23 is a side view of a broken-away heel portion of a filamentary coil coupling member with a third variation of the inside transverse cutaways.
Figure 24:
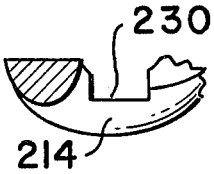
FIG. 24 is a side view of a broken-away heel portion of a filamentary coil coupling member with a fourth variation of the inside transverse cutaways.
Figure 25:
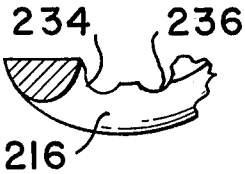
FIG. 25 is a side view of a broken-away heel portion of a filamentary coil coupling member with a fifth variation of the inside transverse cutaways.
Figure 26:
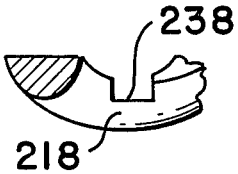
FIG. 26 is a side view of a broken-away heel portion of a filamentary coil coupling member with a sixth variation of the inside transverse cutaways.
Figure 27:
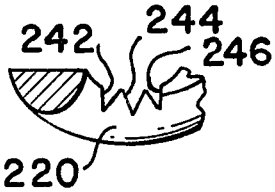
FIG. 27 is a side view of a broken-away heel portion of a filamentary coil coupling member with a seventh variation of the inside transverse cutaways.

Heels 202, 210, 212, 214, 216, 218 and 220 of FIGS. 21–27, respectively, have various cutaways or notch configurations in the inner surfaces of the heels, i.e., on the surfaces of the heels facing the inside of the coil. These notches extend transversely to the longitudinal direction of the coils. In the coil 200 of FIG. 21, notches 204 with a V-shaped cross-section are cut in the heels 202 tranversely to the longitudinal dimension of the coil 200. A narrow transverse slit 226, FIG. 22, is formed in the heel 210. The heel 212 of FIG. 23 has a single rounded cutaway 228. A cutaway 230 of the heel 214 of FIG. 24 has square bottom corners with a flat bottom surface. A pair of rounded cutaways 234 and 236 are spaced in the heel 216 of FIG. 25. A smaller square cutaway 238, compared to the cutaway 230, is formed in the heel 218 of FIG. 226. A plurality of V-shaped notches or cutaways 242, 244 and 246 are formed in the heel 220 of FIG. 27.

It is noted that for the configurations employing pairs of cutaways, such as the configurations of FIGS. 10, 12, 13, 14, 20 and 25, spaced pivotal points for the respective legs joined to the heels are formed at the cutaways. This results in easier slider operation because of reduced pivotal movement at the heels as well as providing mutually closer pivoting points for the pair of legs of each convolution. Similar spaced pivotal points are produced for the flat pair of surface cutaways 132 and 134 of FIG. 12 as well as for the square cutaways formed in FIGS. 24 and 26.

Cutaways can be formed on heels or interconnecting portions of many different types of filamentary coupling members to increase ease of operation. The improved ease of operation and benefits are particularly noticeable in the coils of the embodiments of FIGS. 1–27. Improved ease of operation is also produced in slide fasteners employing stringers with filamentary members such as illustrated in FIGS. 28, 29 and 30.

Figure 28:
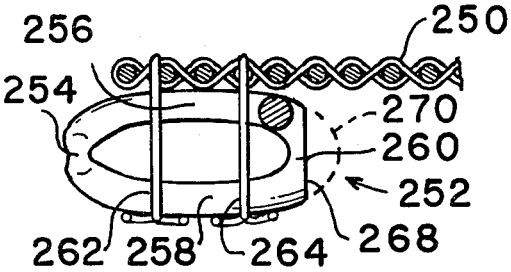
FIG. 28 is a cross-sectional view of a second modification of the stringer in accordance with the invention.

The slide fastener stringer shown in FIG. 28 includes a support tape 250 and a filamentary member indicated generally at 252 and which is secured to the tape 250 by stitching threads 262 and 264. The member 252 is a round coil ladder type fastening member wherein each convolution includes a head portion 254, leg portions 256 and 258 extending from opposite sides of the head portion 254, and connecting portions 260 which connect one of the legs to a corresponding leg of an adjoining convolution. The heels or connecting portions 260 have cutaways or cutouts 268 formed thereon by removing a portion of the heels. The removed portion of the heels is illustrated by the dashed line 270.

Figure 29:
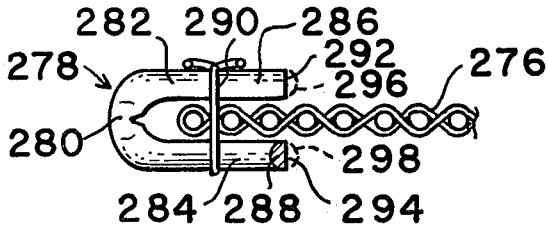
FIG. 29 is a view similar to FIG. 28 of a third modification of the slide fastener stringer in accordance with the invention.

The fastener stringer of FIG. 29 includes a carrier tape 276 and a filamentary coupling member indicated generally at 278. The filamentary member 278 is a meander type of coupling element wherein each convolution includes a head portion 280, a pair of leg portions 282 and 284 extending from opposite sides of the head portion 280, and interconnecting or heel portions 292 and 294 which connect to respective legs of the two adjoining convolutions. The legs 282 and 284 extend on opposite sides of the tape 276 and are secured to the tape 276 by stitching 290. Portions illustrated by the dashed lines 296 and 298 are removed from the heels 292 and 294 to form flat surfaces or cutaways 292 and 294. The cutaways 292 and 294 render the filamentary member 278 substantially more flexible resulting in an easier operating slide fastener.

Figure 30:
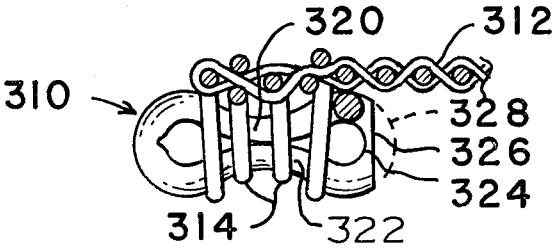
FIG. 30 is a view similar to FIGS. 28 and 29 of a fourth modification of the slide fastener stringer in accordance with the invention.

The slide fastener stringer of FIG. 30 includes a filamentary coil member indicated generally at 310 and which is attached to a supporting tape 312. The member 310 is a coil-like member which includes legs 320 and 322 with a heel or connecting portion 324 which connects each convolution with an adjoining convolution. The coil member 310 is attached by weaving the warp threads 314 of the tape 312 about the convolutions of the member 310. The cutaways 326 render the filamentary member 310 substantially more flexible resulting in an easier operating slide fastener.

Since many variations, modifications and changes in detail may be made to the embodiments described above, it is intended that all matter in the foregoing description and shown in the accompanying drawings be interpreted as illustrative and not in a limiting sense.

What is claimed is:

1. A stringer for a slide fastener comprising a support tape;

a filamentary member mounted on the support tape and including a continuous filament formed into successive convolutions defining coupling elements wherein each coupling element has a head portion, a pair of leg portions extending from opposite sides of the head portion, and a heel portion connecting one of the leg portions to a corresponding leg portion of an adjacent coupling element;

each coupling element being attached to said support tape;

said filament in the leg portion having a substantially uniform cross-sectional area; and said filament in the heel portions having cross-sectional areas along the longitudinal length of said filament which are substantially reduced in size relative to the cross-sectional area of the leg portions by having a portion of the filament removed therefrom whereby flexibility of the stringer of the slide fastener is increased and the weight decreased.

2. A stringer for a slide fastener as claimed in claim 1 wherein the filamentary member is a coil.

3. A stringer for a slide fastener as claimed in claim 1 or 2 wherein each of the heel portions has a groove-like cutaway formed therein by the removal of parts of the heel portions extending longitudinally along the filamentary member.

4. A stringer for a slide fastener as claimed in claim 3 wherein the cutaways have a V-shaped cross section.

5. A stringer for a slide fastener as claimed in claim 3 wherein the cutaways have a rounded cross section.

6. A stringer for a slide fastener as claimed in claim 1 or 2 wherein each of the heel portion has a pair of groove-like cutaways formed thereby by removal of parts of the heel portions extending longitudinally along the filamentary member.

7. A stripper for a slide fastener as claimed in claim 6 wherein the cutaways have a V-shaped cross section.

8. A stringer for a slide fastener as claimed in claim 6 wherein the cutaways have a rounded cross section.

9. A stringer for a slide fastener as claimed in claim 1 wherein the filamentary member is a meander-type member.

10. A stringer for a slide fastener comprising a support tape;

a filamentary member mounted on the support tape and including a continuous filament formed into successive convolutions defining coupling elements wherein each coupling element has a head portion, a pair of leg portions extending from opposite sides of the head portion, and a heel portion connecting one of the leg portions to a corresponding leg portion of an adjacent coupling element;

said filament in the leg portion having a substantially uniform cross-sectional area;

said filament in the heel portion having cross-sectional areas which are substantially reduced in size relative to the cross-sectional area of the leg portions by having a portion of the filament removed therefrom; and wherein the heel portions have flat cutaways formed by having the portions of the filament removed therefrom.

11. A stringer for a slide fastener as claimed in claim 10 wherein the filamentary member is a coil.

12. A stringer for a slide fastener as claimed in claim 10 wherein the filamentary member is a meander-type member.

13. A stringer for a slide fastener comprising a support tape;

a filamentary member mounted on the support tape and including a continuous filament formed into successive convolutions defining coupling elements wherein each coupling element has a head portion, a pair of leg portions extending from opposite sides of the head portion, and a heel portion connecting one of the leg portions to a corresponding leg portion of an adjacent coupling element;

said filament in the leg portion having a substantially uniform cross-sectional area;

said filament in the heel portions having cross-sectional areas which are substantially reduced in size relative to the cross-sectional area of the leg portions by having a portion of the filament removed therefrom; and wherein each of the heel portions has a groove-like cutaway formed therein and extending transversely to the longitudinal dimension of the filamentary member.

14. A stringer for a slide fastener as claimed in claim 13 wherein the cutaways have a V-shaped cross section.

15. A stringer for a slide fastener as claimed in claim 13 wherein the cutaways have a rounded cross-section.

16. A stringer as claimed in claim 13 wherein the cutaways have a rectangular cross section.

17. A stringer for a slide fastener as claimed in claim 13 wherein the cutaways extend on an outside surface of the heels.

18. A stringer for a slide fastener as claimed in claim 13 wherein the cutaways extend on inside surfaces of the heel positions.

19. A stringer for a slide fastener comprising a support tape;

a filamentary member mounted on the support tape and including a continuous filament formed into successive convolutions defining coupling elements wherein each coupling element has a head portion, a pair of leg portions extending from opposite sides of the head portion, and a heel portion connecting one of the leg portions to a corresponding leg portion of an adjacent coupling element;

said filament in the leg portion having a substantially uniform cross-sectional area;

said filament in the heel portions having cross-sectional areas which are substantially reduced in size relative to the cross-sectional area of the leg portions by having a portion of the filament removed therefrom; and wherein each of the heel portions has a pair of groove-like cutaways formed therein and extending transversely to the longitudinal dimension of the filamentary member.

20. A stringer for a slide fastener as claimed in claim 19 wherein the filamentary member is a coil.

21. A method of manufacturing a stringer for a slide fastener comprising the steps of forming a continuous filament into a coupling member having a plurality of successive convolutions such that each convolution includes a head portion, a pair of leg portions extending from opposite sides of the head portion, and an interconnecting portion joining one of the leg portions to a leg portion of an adjoining section;

removing a part of the filamentary material in the interconnecting portions of the coupling member convolutions to substantially reduce the cross-sectional area of the interconnecting portions relative to the remainder of the filament whereby flexibility of the stringer of the slide fastener is increased and the weight decreased; and attaching the filamentary member to a supporting tape.

22. A method as claimed in claim 21 wherein the removing step includes forming groove-like cutaways in the interconnecting portions.

23. A method as claimed in claim 21 or 22 wherein the removing step includes forming groove-like cutaways with a rectangular cross section in the interconnecting portions.

24. A method as claimed in claim 21 wherein the removing step includes forming pairs of cutaways in the interconnecting portions.

25. A method as claimed in claim 21, 22 or 24 wherein the removing step includes milling the interconnecting portions.

26. A method as claimed in claim 21, 22 or 24 wherein the removing step includes forming rounded groove-like cutaways in the interconnecting portions.

27. A method as claimed in claim 21, 22 or 24 wherein the removing step includes forming groove-like cutaways with a V-shaped cross section in the interconnecting portions.

28. A method as claimed in claim 21, 22 or 24 wherein the removing step forms cutaways extending longitudinally along the coupling member.

29. A method as claimed in claim 28 wherein the removing step includes forming the cutaways in an outside surface of the interconnecting portions.

30. A method of manufacturing a stringer for a slide fastener comprising the steps of:

forming a continuous filament into a coupling member having a plurality of successive convolutions such that each convolution includes a head portion, a pair of leg portions extending from opposite sides of the head portion, and an interconnecting portion joining one of the leg portions to a leg portion of an adjoining section;

removing a portion of the filamentary material in the interconnecting portions of the coupling members to substantially reduce the cross-sectional areas of the interconnecting portions;

attaching the filamentary member to a supporting tape; and wherein the removing step includes forming flat bottom surfaces on the interconnecting portions.

31. A method of manufacturing a stringer for a slide fastener comprising the steps of:

forming a continuous filament into a coupling member having a plurality of successive convolutions such that each convolution includes a head portion, a pair of leg portions extending from opposite sides of the head portion, and an interconnecting portion joining one of the leg portions to a leg portion of an adjoining section;

removing a portion of the filamentary material in the interconnecting portions of the coupling member to substantially reduce the cross-sectional area of the interconnecting portions;

attaching the filamentary member to a supporting tape; and wherein the removing step includes forming cutaways extending transversely to the longitudinal dimension of the coupling member.

32. A stringer for a slide fastener as claimed in claim 31 wherein the removing step includes forming groove-like cutaways in the interconnecting portions.

33. A stringer for a slide fastener as claimed in claim 31 wherein the removing step includes forming pairs of cutaways in the interconnecting portions.

34. A method of manufacturing a stringer for a slide fastener comprising the steps of:

forming a continuous filament into a coupling member having a plurality of successive convolutions such that each convolution includes a head portion, a pair of leg portions extending from opposite sides of the head portion, and an interconnecting portion joining one of the leg portions to a leg portion of an adjoining section;

removing a portion of the filamentary material in the interconnecting portions of the coupling member to substantially reduce the cross-sectional area of the interconnecting portions;

attaching the filamentary member to a supporting tape;

wherein the removing step forms cutaways extending longitudinally along the coupling member; and wherein the removing step includes forming the cutaways in an inside surface of the interconnecting portions.

* * * * *